United States Patent [19]

Eigenmann

[11] Patent Number: 4,993,868

[45] Date of Patent: Feb. 19, 1991

[54] CONTINUOUS PREFABRICATED ROAD-MARKING TAPE WITH COMPOSITE STRUCTURE AND PASSIVE AND ACTIVE OPTICAL EFFECT COMPLETELY INDEPENDENT FROM OUTSIDE INVESTMENT AND EXTERNAL ENERGY SOURCE

[75] Inventor: Ludwig Eigenmann, Lugano, Switzerland

[73] Assignee: Minnesota Mining and Manufacturing Co., St. Paul, Minn.

[21] Appl. No.: 349,625

[22] Filed: May 10, 1989

Related U.S. Application Data

[63] Continuation of Ser. No. 73,231, Jul. 14, 1987, abandoned, which is a continuation-in-part of Ser. No. 888,315, Jul. 22, 1986, abandoned.

[30] Foreign Application Priority Data

Jul. 23, 1985 [CH] Switzerland ..... 03197/85

[51] Int. Cl.[5] ..... E01F 9/06

[52] U.S. Cl. ..... 404/12; 404/14

[58] Field of Search ..... 404/9, 12–14, 404/16; 116/63 R, DIG. 15; 340/907, 917; 362/153.1

[56] References Cited

U.S. PATENT DOCUMENTS

| | | | |
|---|---|---|---|
| 1,356,455 | 10/1920 | Lyman | 116/63 R X |
| 1,939,436 | 12/1933 | Conn | 250/206 |
| 2,700,754 | 1/1955 | McCullough | 362/153.1 |
| 2,849,701 | 8/1958 | Clark | 404/9 X |
| 3,529,214 | 9/1970 | Corn | 250/206 |
| 3,584,222 | 6/1971 | Nesbitt | 250/206 |
| 3,585,585 | 6/1971 | Grosz | 362/84 |
| 3,587,415 | 6/1971 | Eigenmann | 404/9 X |
| 3,705,310 | 12/1972 | Wild | 350/331 T |
| 3,727,063 | 4/1973 | Turner | 250/206 |
| 3,836,275 | 9/1974 | Finch | 404/13 |
| 3,996,556 | 12/1976 | Eigenmann | 404/14 X |
| 4,050,834 | 9/1977 | Lee | 404/16 |
| 4,080,085 | 3/1978 | Dickson | 404/14 |
| 4,095,100 | 6/1978 | Selick | 250/206 |
| 4,177,405 | 12/1979 | Chapdelaine | 250/206 |
| 4,484,104 | 11/1984 | O'Brien | 315/149 |

*Primary Examiner*—Ramon S. Britts
*Assistant Examiner*—Matthew Smith
*Attorney, Agent, or Firm*—Robert A. Elwell; Harold D. Jastram

[57] ABSTRACT

A continuous horizontal road-marking tape is described. The road-marking tape includes Light Emitting Diodes (LEDs) or high intensity microlamps, solar cells and retroreflecting elements. The LEDs may be double and focused for better visibility, their light is pulsing at a regular speed or at an emergency fast speed. The road-marking tape balances the solar energy captured by its solar cells with the emitted light employed to signal or warn motorists. Also described is the use of an emergency fast pulsing for signalling an emergency or the presence of ice, and the use of the tape for controlling situations where a single lane of roadway must alternatively pass traffic from two different directions. Activation of the light emitting sources is by sensing light from headlights of oncoming cars or by traffic lights.

9 Claims, 5 Drawing Sheets

CONTINUOUS PREFABRICATED ROAD-MARKING TAPE WITH COMPOSITE STRUCTURE AND PASSIVE AND ACTIVE OPTICAL EFFECT COMPLETELY INDEPENDENT FROM OUTSIDE INVESTMENT AND EXTERNAL ENERGY SOURCE

CROSS-REFERENCE TO RELATED APPLICATIONS

This Application is a continuation of Applicant's Application Ser. No. 07/073,231, filed Jul. 14, 1987, now abandoned; which was a continuation-in-part of Applicant's Application Ser. No. 888,315 filed Jul. 22, 1986, which is also now abandoned.

BACKGROUND OF THE INVENTION

The present invention relates to horizontal road-marking and in particular to light emitting horizontal road-marking tapes.

The problem of traffic safety, especially at night, has prompted a good deal of study and experimentation. A considerable contribution in the specific field of the horizontal road-marking has been previously made by the applicant.

There are two different kinds of road-markings, vertical road-markings and horizontal road-markings.

Horizontal road-marking is an especially challenging problem. Horizontal road-marking is important because it is situated within the arc of the human sight. In order to be efficient, horizontal road-marking has to be continuous. In order to maintain its efficiency, horizontal road-marking must also avoid diverting a motorist's attention to something different.

Anything different or anything needed from outside of the road-marking is negative and detracts from the safety efficiency of the marking because it diverts the motorist's attention from the road-marking itself.

In addition to numerous inventions regarding nighttime traffic safety, based on the use of retroreflecting elements, the applicant has also developed systems which incorporate their own light source. Under particularly foggy or misty conditions, the efficiency of such systems is superior to systems employing retroreflecting elements Retroreflective systems, however, have become increasingly efficient in recent years, also through developments made by the applicant.

The applicant has claimed the development of a marking tape that gives off its own light in his Italian Pat. Nos. 982.743 and 990.780, and in his corresponding U.S. Pat. No. 3,996,556. The light is produced by incandescent or fluorescent lamps or by luminous pigments activated by visible and even non-visible light.

On the one hand, however, these light sources are not well suited for sustaining the stress of traffic and, in addition, have rather short service lives when kept constantly lit, say, during the nighttime hours. On the other hand, there is the consideration of the required current, especially if it is necessary to use, in the practical case, storage batteries to supply this current.

SUMMARY OF THE INVENTION

As in the above mentioned case, the present invention involves the use of a luminous marking tape applied to the roadway surface, which is not simply an improvement over the above mentioned type but actually represents an important innovation that ingeniously combines the most up-to-date technical discoveries in order to achieve the objective.

The present invention exploits solar energy to produce electrical energy on the road-marking tape itself. Solar cells, of course, are well known and can be exploited by use with storage batteries. Specifically, solar cells and batteries can be positioned beside or near the road-markings, but many practical problems remain and are difficult to solve. For example, road-markings are needed in many different locations and the highest safety level for road-marking is achieved by the absence of disturbing elements external to a road-marking tape.

In order to achieve an energy balance which can be sustained for years, the electrical energy and emitted light must be produced on the road-marking tape by integrated circuits.

The applicant has faced the difficulties of the problem and has developed the present invention.

The present invention also envisions the use of Light Emitting Diodes (LEDs) for providing the light for the marking tape. When, for example, a 6-volt potential is applied to these appropriately "doped" semiconductors, they emit photons and become luminous and are visible over long distances during the nighttime hours.

The amount of energy is very low as compared to the energy corresponding to the same amount of light by an incandescent lamp.

The produced light can be more or less focused and, depending on the particular type of "doping" used, certain colors can be obtained.

It was also unexpectedly found that LEDs are resistant to traffic vibrations, which are significant vibrations even if not very perceptible to our physical senses.

According to this invention, the LEDs are distributed and appropriately spaced (indicatively but not necessarily at intervals of several tens of centimeters) along the marking tape, and contained inside of protruding transparent capsules imbedded in the marking tape itself, as shown more clearly in the diagram described further on. In all cases, the characteristic which is common for all the variations of this invention is the ability of the luminous marking tape to be activated by the light coming from the headlights of the oncoming vehicles. In this case, the marking tape is activated on command for the length of time necessary to alert the motorist of an emergency situation.

Provision is also made for the marking tape to be activated by the traffic signal lights.

One of the very important possibilities offered by the luminous marking tape described in this invention is that of providing differentiated lighting pulsings of the LEDs; that is a regular pulsing or a fast pulsing in emergency cases, as it will be specified later.

In all the cases considered, provision is made for the combined use of retroreflecting and lighting elements for nighttime road-marking service. Such a combination of elements can be particularly useful in an emergency situation where the light emitting road-marking devices of this invention fail to illuminate due to their electric current being interrupted for any reason whatsoever.

A very important feature of the present invention resides, of course, in the fact that the energizing of the LEDs and of the other devices, as later described, is completely independent from external sources. In fact, solar cells are foreseen, distributed along the tape, which, together with storage batteries, supply the needed energy. These and other features will be specified in detail with reference to the enclosed drawings.

Further, the continuous prefabricated tape of the present invention can be laid down and firmly secured anywhere a road marking is needed on the roadway without dependence on an external energy source and provide not only retroreflected light but also emitted light.

This very important result has been reached by the recognition and exploitation of four important points contributing to the final energy balance.

(1) The continuous tape surface presents transparent protrusions distributed lengthwise, which include not only retroreflecting components, but also solar cells which are feeding small storage batteries, also protected in said protrusions, for the regular lighting of the LEDs by night.

(2) The necessary energy balance could never be secured by solar energy produced on the tape if the LEDs would not be activated by a photocell struck or activated by the headlights of the incoming vehicles.

(3) As the solar energy intensity is so different in the various weather conditions and seasons, the lighting of the LEDs will be a pulsing one, in order to save energy.

(4) The optical effect is very much connected with energy consumption; that is, connected with an energy balance, and consequently the concentration or focusing of light irradiation at high brilliance is very important. The light, therefore, should be focused in the direction of the incoming taffic and, for best results, the LEDs should be coupled. The double LEDs may be placed or arranged in such a way that their light beams are slightly converging, at a suitable distance, in order to increase their brilliance.

These four points are basic for a road-marking tape which is completely independent from external energy sources. A road-marking tape incorporating these features may be positioned anywhere it is needed, and not just where an energy source can be made available.

In an alternative embodiment, the road-marking tape corresponding to the above-mentioned features can be activated not only by the oncoming traffic, but also, by using optical fibers, by traffic lights or by traffic signals.

The available solar energy appears to be insufficient in order to ensure visibility in the presence of fog, but it has been found that a very few high intensity microlamps, like the OL 06 LAMP LXTI Oshino, are very efficient, and when positioned just in dangerous locations the corresponding consumption may be tolerated by the solar energy balance.

Two pulsing speeds or rates of the LEDs lighting have been adopted. Both of these pulsing speeds are based, for example, on a ⅓ time lighting. The two different pulsing speeds allow, therefore, a regular pulsing and a fast pulsing for emergency purposes. This emergency pulsing, for example in case of an accident, may be activated by the wheel of a car, pressing on a microswitch for a predetermined time, as it will be explained more in detail with reference to the enclosed drawings.

The emergency pulsing can also be activated by an electronic switch connected with a low temperature circuit based on a NTC (Negative Temperature Control) sensor. The techniques of the NTC sensor are well known.

Another important problem is the control of one lane traffic in alternate directions by means of two marking tapes on the two sides of the road which are provided with photocells activated by the first oncoming car and are connected by a cable across the road. As will be explained with reference to FIG. 6, when the photocell FA, activated by an incoming car CA, lights the green LEDs A, the photocell FB is prevented from lighting the green LEDs B. Vice versa, in the case when photocell FA is not activated, but photocell FB is activated by an oncoming car CB, the photocell FA is prevented from lighting the green LEDs A.

DETAILED DESCRIPTION OF THE PREFERRED EMBODIMENT

Figure 1:
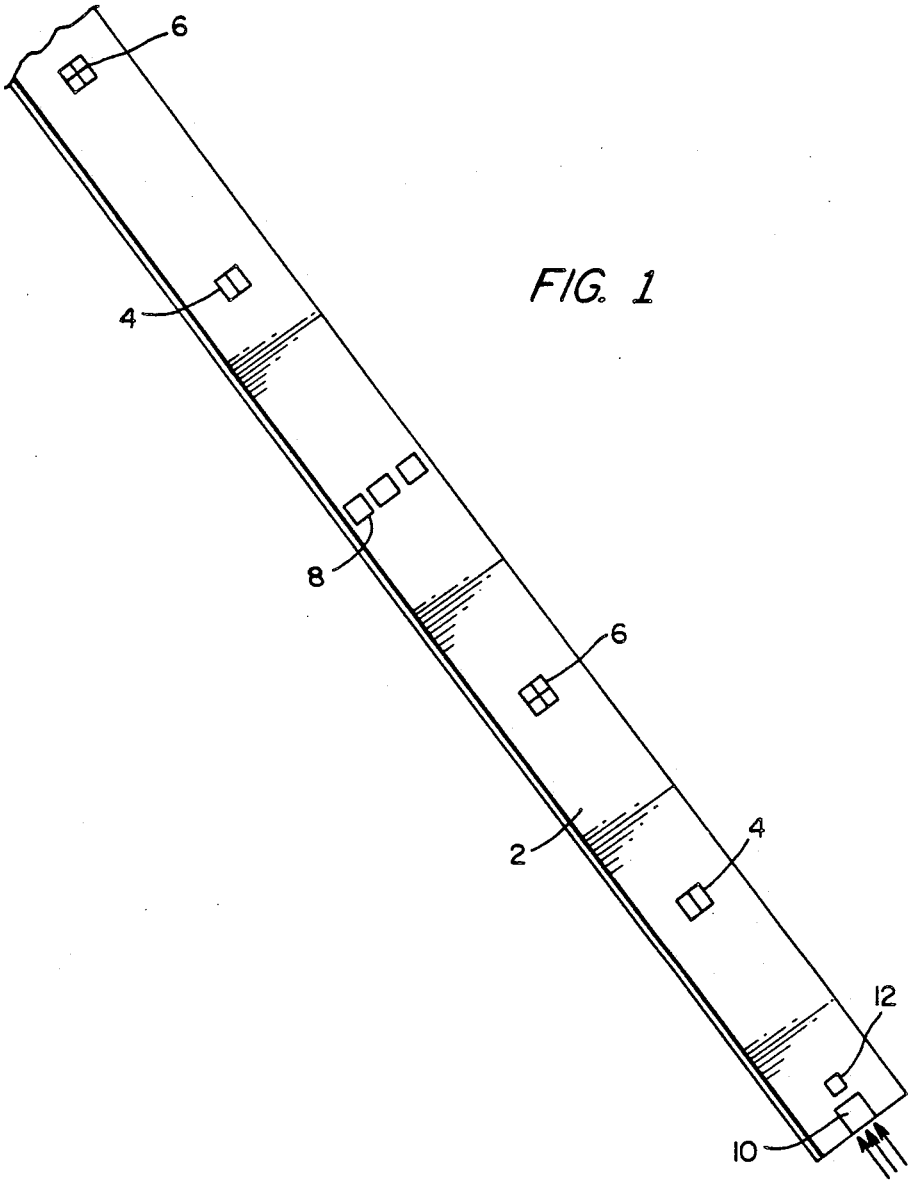
FIG. 1 shows a continuous tape, with protrusions including LEDs, retroreflective elements, solar cells, storage batteries, and a control light detector.

In FIG. 1 there is illustrated the beginning portion of the marking tape 2; there are shown transparent protrusions 4, in which double LEDs 14 (of FIG. 2) are contained, and transparent protrusions 6 in which solar cells are contained; by 8 there are indicated storage batteries, while at 10 there is represented a light detector (photocell or phototransistor) which, struck by the headlights of an oncoming vehicle, actuates by means of a pulsing device (timer) 12 the pulsing light of the LEDs.

The brilliancy of the LEDs may be improved by means of small lenses which concentrate the light beams; this, together with the doubling of the LEDs, improves substantially their visibility.

Inside of the transparent protrusions 4, or near them, there are placed retroreflecting elements of one of the types protected by several patents of the applicant, for example.

The light detector 10 may be provided with a light-focusing unit, which may be oriented so as to gather and selectively focus the light coming from the vehicles considering only certain angles of incidence; this to avoid the activation by light beams not coming from the headlights of vehicles.

Figure 2:
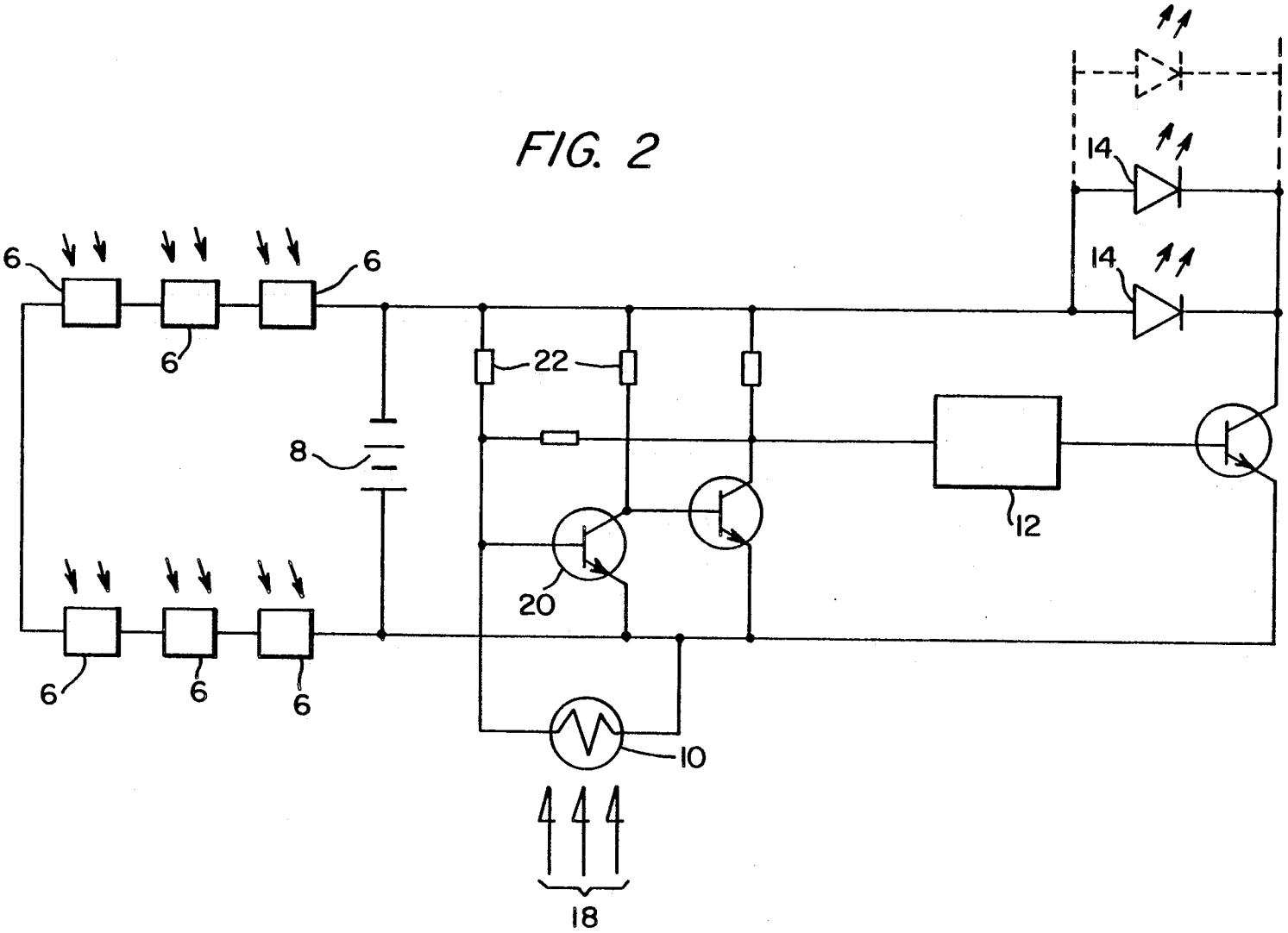
FIG. 2 represents a non-limiting example of a circuit for realizing what is illustrated in FIG. 1.

FIG. 2 shows, by way of a non-limiting example, how the devices shown in FIG. 1 may be connected together.

When the light detector (photocell or phototransistor) 10 receives the light from the headlights 18 of an approaching vehicle, the circuit that feeds energy to the LEDs 14 is closed by means of transfer units 20 and resistors 22. The timer 12 causes the pulsing of the light emitted by the LEDs 14.

As earlier mentioned, the pulsing of the light enables saving of energy, but it has also the advantage of reviving the attention of the vehicle driver; the time 12 may be set, for example, for a ⅓ lighting.

The circuit of FIG. 2 is only an example, and the present invention can be realized using any other type of circuit that connects up the various elements so as to give the same results.

Figure 3A:
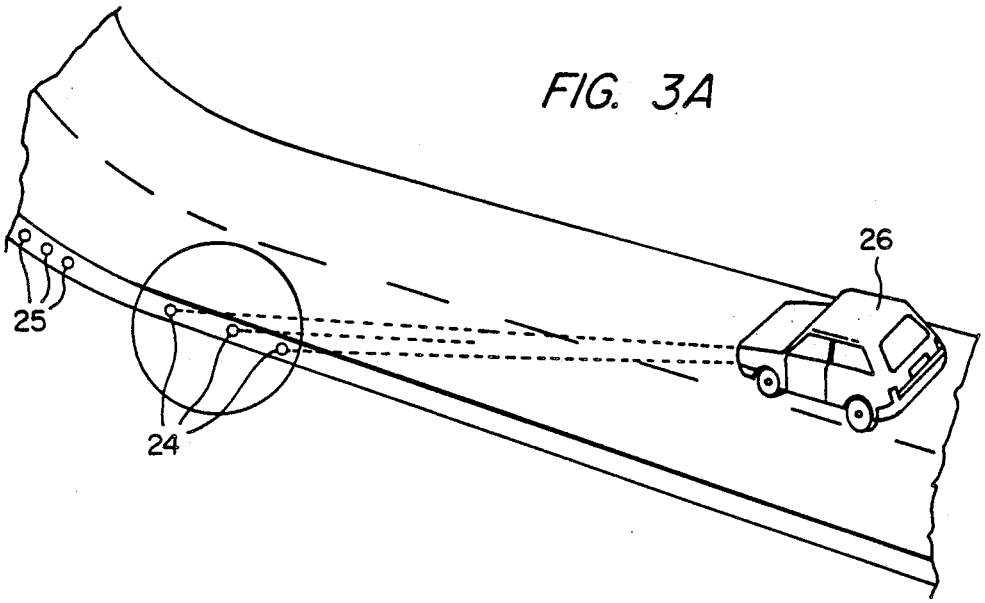
FIGS. 3 A and B show double LEDs 24 placed at the beginning of a bend of the road, and focused towards an oncoming vehicle; high intensity microlamps are also shown.
Figure 3B:
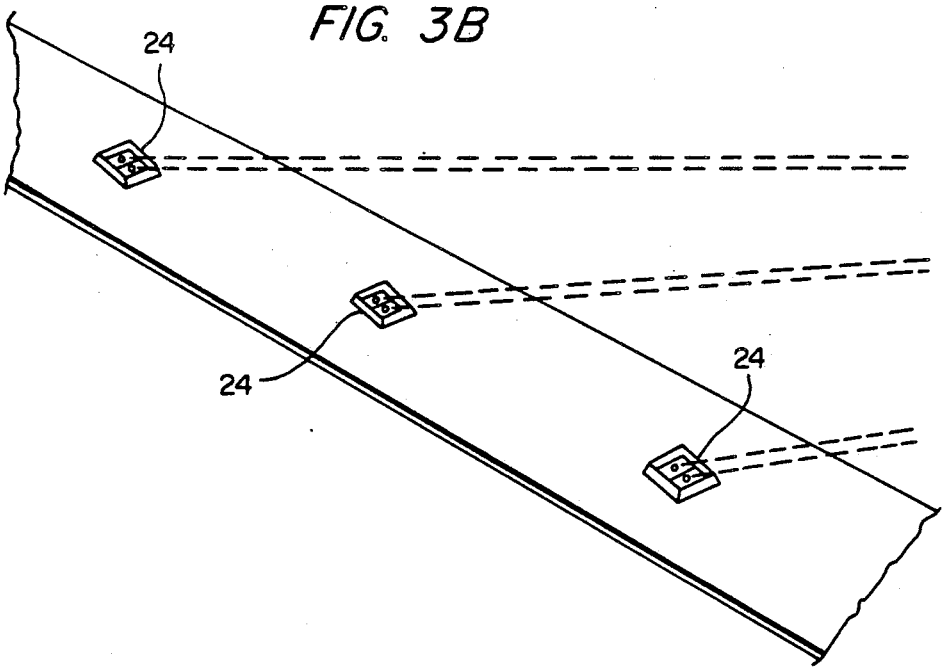

The efficiency of the lighting of the LEDs must be particularly high in hazardous locations. FIG. 3 shows the arrangement of double focused LEDs at the beginning of a bend of the road. Of course, the same arrangement is repeated along the bend of the road. FIG. 3A shows three double LEDs 24 which are placed or arranged in such a way that their beams converge towards a car 26. The alternative light emission devices, high intensity microlamps 25, are also shown arranged to produce convergent light beams. FIG. 3B is an enlarged detail of the double LEDs of FIG. 3A.

Figure 4:
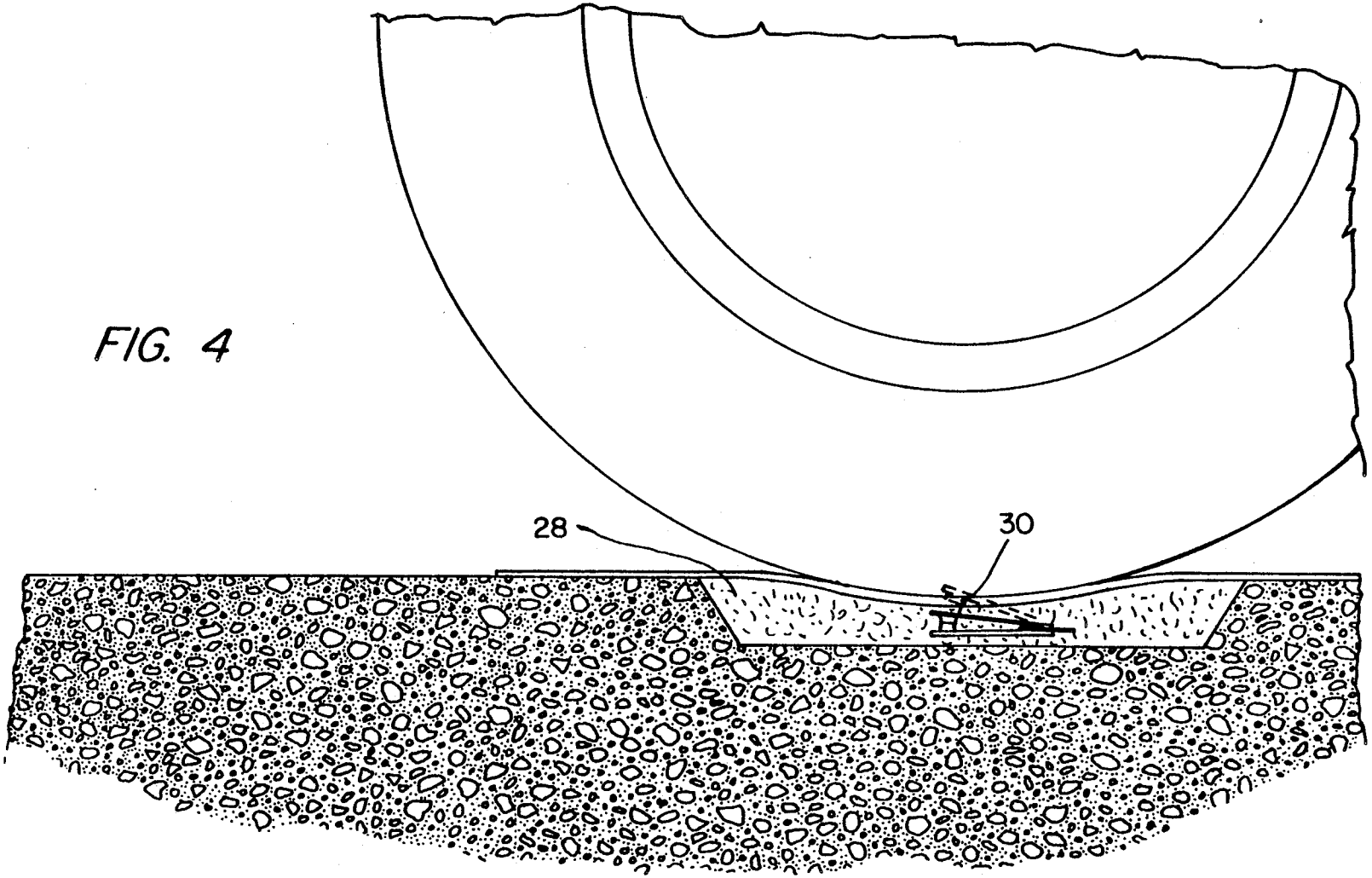
FIG. 4 shows an arrangement of a microswitch activating the fast emergency pulsing of the LEDs.

In FIG. 4 there is represented the wheel of a vehicle pressing on a section 28 of a compressible tape, inside of which a microswitch 30 is placed.

This arrangement enables actuation of the fast pulsing of the LEDs, in order to warn of an emergency situation such as, for example, an accident. The presence and the location of the emergency microswitch is indicated by a traffic sign, informing a motorist desiring to warn other motorists that to activate the emergency lighting it is necessary to bring the wheel of one's vehicle into a signalling position atop the microswitch. The fast pulsing is operated by means of a circuit which is similar to the circuit of FIG. 2, where instead of the light detector 10 there is the microswitch 30, and a second timer is inserted, in order to cause a time lag between the pressing of the wheel on the microswitch and energizing of the fast pulsing LEDs circuit. Said second timer's delay function has the purpose of avoiding a nondeliberate passage of a vehicle on the tape section 28 causes the lighting of the emergency LEDs.

A compressible tape, as illustrated in FIG. 4, has been described in the applicant's U.S. Pat. Application Ser. No. 763,421, for which a patent has been recently granted (U.S. Pat. No. 4,685,824, issued Aug. 11, 1987).

As it has been still remarked, the emergency fast pulsing may also be activated with the purpose of warning the car driver of the possible presence of ice on the roadway surface.

Figure 5:
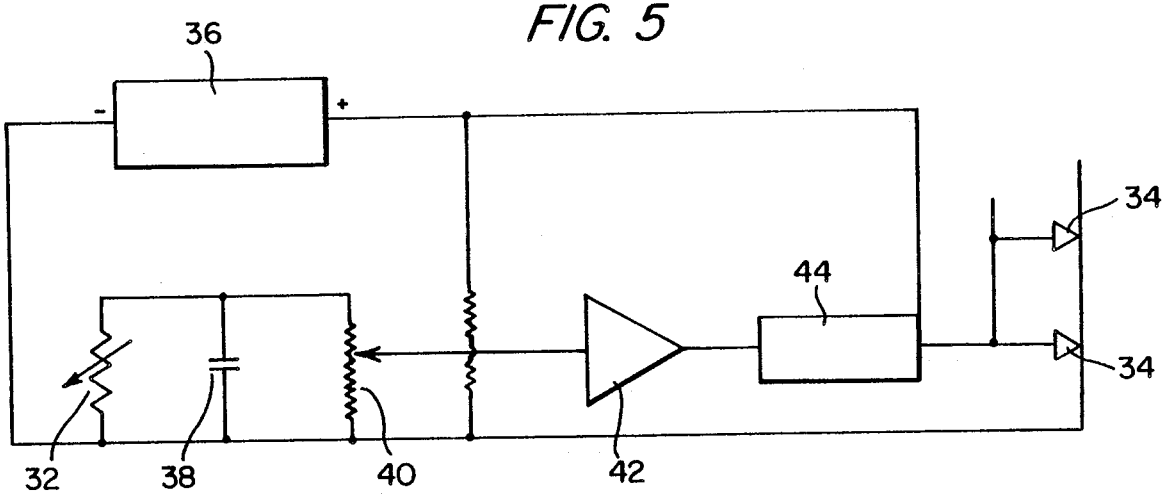
FIG. 5 shows a non-limiting example of a circuit including a NTC sensor.

In FIG. 5 there is shown a circuit for realizing said feature, using a NTC (Negative Temperature Control) sensor 32; the LEDs 34 are energized by the solar batteries 36, and the circuit includes a capacitor 38, a potentiometer 40, a differential amplifier 42 and timer 44, which controls the fast emergency pulsing.

Figure 6:
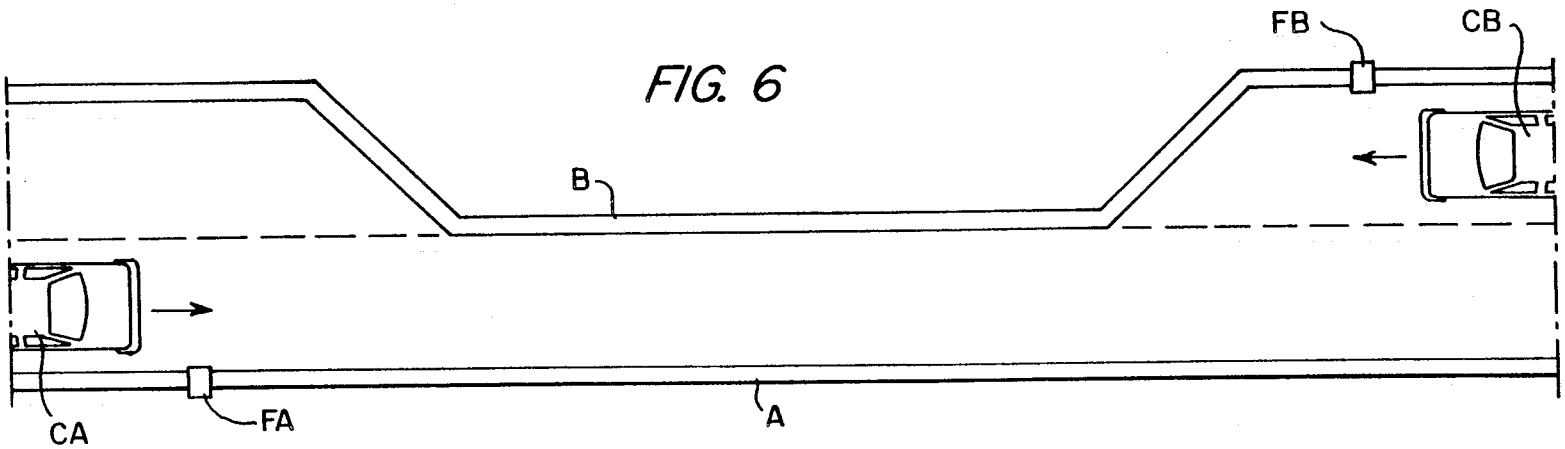
FIG. 6 shows a lane with traffic in alternate directions.

FIG. 6 represents the narrowing of a roadway to a single lane where the traffic may pass only in one direction at a time, for example, because of roadwork. There is shown two marking tapes, one at each side of the roadway and of the single lane, on which colored green LEDs are placed; the two tapes are connected by means of a cable 46.

For example a car CA which first arrives from one direction activates the photocell FA, lights the LEDs A, and prevents photocell FB from lighting the LEDs B. Vice versa, if photocell FA is not activated, and photocell FB is first activated by car CB, the photocell FA is prevented from lighting LEDs A while LEDs B are flashing green signals to the motorist of car CB.

A tape employed for the above-mentioned purposes is preferably removable to allow the traffic to be returned to normal patterns as soon as possible after the road is repaired. The marking tape described in the applicant's U.S. Pat. No. Re 31,669, reissue of Patent No. 4,146,635, has, among other features, the characteristics of being easily removed without inconveniences, for a further use.

All the electrical circuits which realize the different embodiments as above described are secured by spikes and narrow metal nets dipped in the adhesive layer of the marking tape.

I claim:

1. Continuous prefabricated road-marking tape, of the type which may be firmly secured to the road surface and which is resistant to the aggression of weather and vehicular traffic said tape including:

(a) protective protrusions on the road-marking upper face;

(b) reflective elements housed within said protrusions, so that a reflective surface is exposed to the headlights of an approaching vehicle;

(c) light emitting diodes (LEDs) housed within said protrusions, and which emit light toward the approaching vehicle;

(d) an electrical circuit extending within said tape and including solar cells; said light emitting, a photocell switch and storage batteries housed within and protected by said protrusions, said diodes being controlled by said photocell switch, such that said solar cells energize said storage batteries during the day and at night said batteries energize said diodes by an energy balance assured by a light detector which activates said circuit as signalled by an approaching vehicle headlight and wherein the light detector is provided with a light focusing unit oriented so as to selectively focus the light coming from the vehicles.

2. A continuous, prefabricated road-marking tape of the type which may be firmly secured to the road surface and is resistant to the aggression of weather and vehicular traffic, said tape including:

(a) protective protrusions on the road-marking upper face;

(b) reflective elements housed within said protrusions, so that a reflective surface is exposed to the headlights of an approaching vehicle;

(c) light emitting diodes (LEDs) housed within said protrusions, and which emit light toward the approaching vehicle;

(d) an electrical circuit extending within said tape and including:

solar cells;

said light emitting diodes;

a first photocell switch on the tape; and storage batteries housed within and protected by said protrusions;

said diodes being controlled by said first and second photocell switch, such that said solar cells energize said storage batteries during the day and at night said batteries energize said diodes by said second photocell switch which activates said circuit as signalled by an approaching vehicle headlight.

3. Continuous prefabricated road-marking tape as in claim 2, where the LEDs are subjected to fast pulsing lighting activated by a microswitch closed by the pressure of the wheel of a vehicle for a predetermined period of time.

4. Continuous prefabricated road-marking tape as in claim 2, where the LEDs are subjected to fast pulsing lighting controlled by a NTC (Negative Temperature Control)sensor.

5. A continuous, prefabricated road-marking tape of the type which may be firmly secured to the road surface and is resistant to the aggression of weather and vehicular traffic, said tape including:

(a) protective protrusions on the road marking upper face;

(b) reflective elements housed within said protrusions, so that a reflective surface is exposed to the headlights of an approaching vehicle;

(c) light emitting diodes (LEDs) housed within said protrusions, and which emit light toward the approaching vehicle;

(d) an electrical circuit extending within said tape and including solar cells; said light emitting diodes, a photocell switch and storage batteries housed within and protected by said protrusions, said diodes being controlled by said photocell switch, such that said solar cells energize said diodes by an energy balance assured by a light detector which activates said circuit as signalled by an approaching vehicle headlight, and wherein said light emitting diodes are integrated in high intensity microlamps in said circuit.

6. A continuous, prefabricated road-markign tape of the type which may be firmly secured to the road surface and is resistant to the aggression of weather and vehicular traffic, said tape including:

(a) protective protrusions on the road-marking upper face;

(b) reflective elements housed within said protrusions, so that a reflective surface is exposed to the headlights of an approaching vehicle;

(c) light emitting diodes (LEDs) housed within said protrusions, and which emit light toward the approaching vehicle;

(d) an electrical circuit extending within said tape and including solar cells; said light emitting, a photocell switch and storage batteries housed within and protected by said protrusions, said diodes being controlled by said photocell switch, such that said solar cells energize said storage batteries during the day and at night said batteries energize said diodes by an energy balance assured by a light detector which activates said circuit as signalled by an approaching vehicle headlight and wherein said light emitting diodes include a light focusing unit so as to converge emitted light from said diodes toward said approaching vehicle.

7. A continuous, prefabricated road marking tape of the type which may be firmly secured to the road surface and is resistant to the aggression of weather and vehicular traffic, said tap including:

(a) protective protrusions on the road markign upper face;

(b) reflective elements housed within said protrusions, so that a reflective surface is exposed to the headlights of an approaching vehicle;

(c) light emitting diodes (LEDs) housed within said protrusions, and which emit light toward the approaching vehicle; and (d) an electrical circuit extending within said tape and including solar cells, said light emitting diodes, a photocell switch and storage batteries housed within and protected by said protrusions, said diodes being controlled by said photocell switch, such that said solar cells energize said storage batteries during the day and at night said batteries energize said diodes by an energy balance assured by a light detector which activates said circuit as signalled by an approaching vehicle headlight, said electrical circuit further including a timer connected to said light emitting diodes, so as to actuate two different light pulsing speeds, namely a regular light pulsing speed and an emergency fast pulsing speed.

8. A continuous prefabricated road-marking tape of the type which may be firmly secured to the road surface and which is resistant to the aggression of weather and vehicular traffic said tape including:

(a) protective protrusions on the road-marking upper face;

(b) reflective elements housed within said protrusions, so that a reflective surface is exposed to the headlights of an approaching vehicle;

(c) light emitting diodes (LEDs) housed within said protrusions, and which emit light toward the approaching vehicle;

(d) an electrical circuit extending within said tape and including solar cells; said light emitting, a photocell switch and storage batteries housed within and protected by said protrusions, said diodes being controlled by said photocell switch, such that said solar cells energize said storage batteries during the day and at night said batteries energize said diodes by an energy balance assured by a light detector which activates said circuit as signalled by an approaching vehicle headlight and wherein the light detector is provided with a light focusing unit.

9. Continuous prefabricated road-marking tape, of the type which may be firmly secured to the road surface, the tape having a plurality of protrusions on the road-marking upper face, the tape comprising:

a plurality of LEDs protected by one or more protrusions of the tape;

means, protected by a protrusion of the tape, for exploiting solar energy incident upon the tape to produce electrical energy;

means, protected by a protrusion of the tape, for storing electrical energy, and means, protected by a protrusion of the tape, for balancing energy between LEDs, the means for exploiting solar energy, and the means for storing solar energy, to exploit only the solar energy incident on the tape to produce sufficient energy for lighting of the LEDs in response to a headlight of an incoming vehicle.

* * * * *

UNITED STATES PATENT AND TRADEMARK OFFICE

CERTIFICATE OF CORRECTION

PATENT NO. : 4,993,868

DATED : February 19, 1991

INVENTOR(S) : Ludwig Eigenmann

It is certified that error appears in the above-identified patent and that said Letters Patent is hereby corrected as shown below:

In Col. 7, line 24, "markign" should read --marking--.

In Col. 7, line 54, "tap" should read --tape--.

In Col. 7, line 56, "markign" should read --marking--.

Signed and Sealed this

Twenty-first Day of July, 1992

*Attest:*

DOUGLAS B. COMER

*Attesting Officer*

*Acting Commissioner of Patents and Trademarks*